United States Patent [19]

Blessing

[11] Patent Number: 4,538,479

[45] Date of Patent: Sep. 3, 1985

[54] MACHINE TOOL LEVERAGE CONTROL HANDLE

[76] Inventor: Kenneth C. Blessing, 2757 Leach Rd., Auburn Heights, Mich. 48057

[21] Appl. No.: 321,629

[22] Filed: Nov. 16, 1981

[51] Int. Cl.[3] ..... G05G 5/06

[52] U.S. Cl. ..... 74/528; 74/532; 81/177.7; 81/177.9

[58] Field of Search ..... 74/527, 528, 532, 545–547; 81/121 R, 121 B, 177 ST, 177.9, 177.75

[56] References Cited

U.S. PATENT DOCUMENTS

| | | | |
|---|---|---|---|
| 1,531,732 | 3/1925 | Burkholder | 81/177.75 |
| 1,643,814 | 9/1927 | Peterson | 81/177 ST |
| 1,719,310 | 7/1929 | Rawlings | 81/177.9 |
| 3,148,903 | 9/1964 | Foster | 74/528 X |

FOREIGN PATENT DOCUMENTS

| | | | |
|---|---|---|---|
| 597165 | 8/1925 | France | 81/177 ST |

*Primary Examiner*—James A. Leppink
*Assistant Examiner*—Frank H. McKenzie, Jr.
*Attorney, Agent, or Firm*—Gerald R. Hershberger

[57] ABSTRACT

A reversible torque hand crank or lever for machine tools comprises a generally elongated cylindrically outlined hub having a blind bore located axially in the mounting face of the hub for mounting the hub fixedly to a feed mechanism shaft of the machine. The end of the hub opposite the mounting face has a generally flat lever mounting face substantially parallel to the hub mounting face. An arm guide channel having parallel arm support side walls and oppositely disposed symmetrical straight bottom walls which walls are sloped from the apex to form guide arm support planes depending outwardly at an obtuse angle to the hub faces is located diametrically and transversely on said hub.

A pair of oppositely disposed hub bearing bores are transversely located in said hub perpendicular to said channel at its apex. An elongated crank lever arm having a bearing in one end is pivotably and slidably mounted in said hub channel by a moderately sized pin inserted through the hub bearing and lever bearing bore allowing the lever to pivot from side to side in the channel with a substantial portion of the lever extending outside of the channel and biased outwardly for leverage. The channel arrangement provides quick reversal of the arm from one side to the other and to the arm under conditions of extreme load in turning the hub. Detent means is provided in the hub to hold the crank arm releasably in either position.

1 Claim, 5 Drawing Figures

MACHINE TOOL LEVERAGE CONTROL HANDLE

BRIEF SUMMARY OF THE INVENTION

This invention relates generally to improvement in hand controls for machine tools and more particularly to a reversible channel-locking hand crank or lever mechanism for adjustment of the mechanical functions of a power tool such as a bridgeport milling machine.

Hand cranks, wheels, levers, and the like of general type are currently in use on machine tools for adjustment of feed mechanisms thereon, however, such hand cranks, etc., have wheels or hubs with fixed handles or levers thereon. Some such conventional wheels or cranks provide for radial torque adjustment of the handle with respect to the spindle by removal of the wheel or hub from the spindle and repositioning of the hub on spaced bores in the hub over a pin on the machine spindle. This means for adjusting the torque is obviously a cumbersome, time consuming, and unwieldly procedure.

Therefore, in order to save valuable work time by improving the speed of operation of the power machine tool by the operator, I provide a sturdy, heavy duty, and efficiently operating hand crank and lever mechanism for a power machine tool that can quickly and efficiently be adjusted on the machine to find the angle of greatest operative leverage without removing the wheel or crank from the machine.

It is accordingly an object of this my invention to provide a torque reversible channel-locking handle or arm cranking mechanism for a machine tool.

It is a further object of this my invention to provide a utilitarian, efficiently operated, and conveniently arranged torque reversible, and readily adjustable cranking mechanism for a machine tool.

It is a further object of this my invention to provide a machine tool feed adjusting crank mechanism for a power machine tool having a hub of solid metal and a cross recess machined therein to accept a reversible, pivotable torque arm.

It is a further object of this my invention to provide a machine adjusting crank mechanism with a hub member having a channel-like slot therein and an arm or handle pivotably mounted centrally in the slot for use with a bridgeport type milling machine.

It is a further object of this my invention to provide means for releasably detaining the arm in the slot or channel.

The present invention may be better understood and numerous other features and advantages thereof will become apparent to those skilled in the art by reference to the accompanying drawing wherein like reference numerals refer to like elements in the various figures in which.

Figure 1:
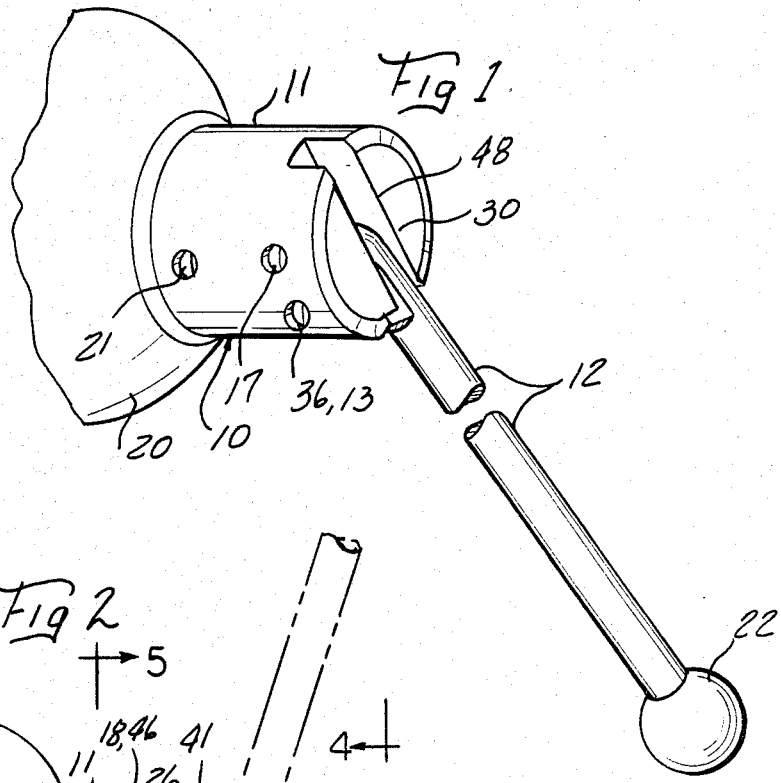
FIG. 1 is a pictoral view showing my device installed on the spindle adjusting shaft of the vertical feed mechanism of a power machine tool.
Figure 2:
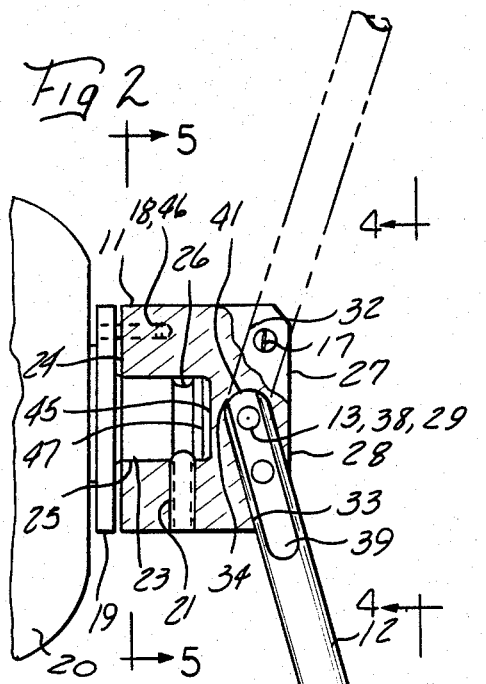
FIG. 2 is a cross-sectional view of my invention taken in the direction of arrows 2—2 of FIG. 4, with the handle down instead of up.
Figure 3:
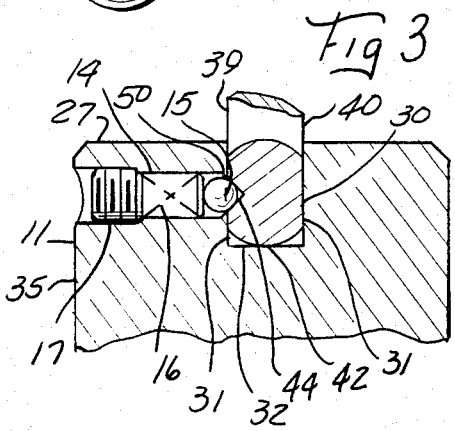
FIG. 3 is a cross-sectional view taken in direction of arrows 3—3 of FIG. 4, showing the detent mechanism enlarged.
Figure 4:
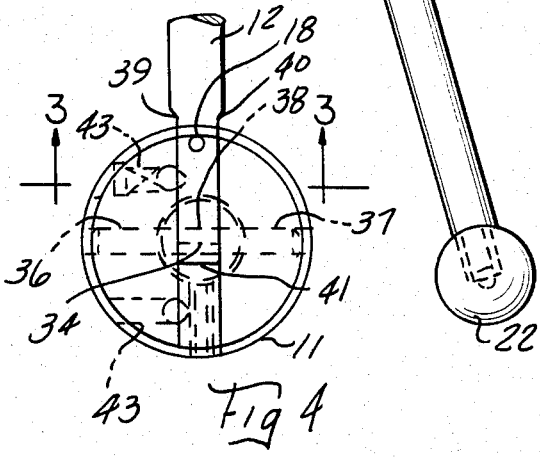
FIG. 4 is a plan view of the device taken in direction of arrows 4—4 of FIG. 2.
Figure 5:
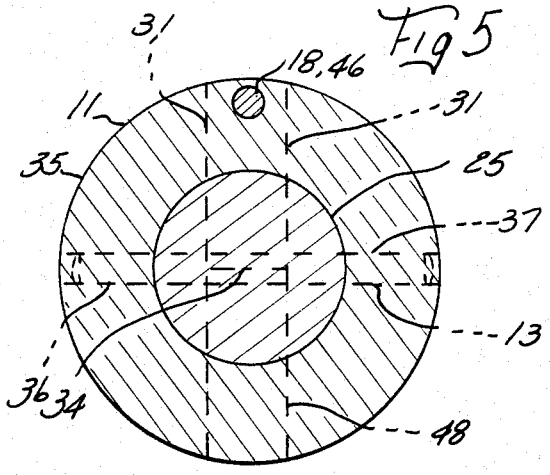
FIG. 5 is an enlarged sectional view taken in direction of arrows 5—5 of FIG. 2, showing the attachment of the crank hub to the spindle of the machine.

Referring now in detail to the drawing the numeral 10 denotes my reversible machine tool hand cranking device constructed in accordance with my invention, and shown mounted on the spindle of a Bridgeport Milling Machine 20.

My invention comprises a generally elongated cylindrically outlined solid hub member 11 having a blind mounting bore 23 located axially into the hub member through the generally flat mounting face 24 of said hub member. The bore 23 extends partially through the hub longitudinally stopping adjacent blind wall 45. The bore is adapted to fit the shaft 25 of the machine spindle 19. A spindle turn or torque resisting pin member 18 is fixedly mounted at one end in the spindle offset and parallel to shaft and spindle axis 29. The other end of the pin is inserted in a single element bore 46 in the hub mounting face 24 to prevent radial movement of the hub with respect to the spindle. A set screw 21 engages radial groove 26 in the end 47 of said spindle to prevent endwise movement of said hub with respect to said spindle shaft.

The handle or arm end 27 of the hub has a generally flat disc-like face 28 formed substantially parallel to said mounting face and normal to the hub member and spindle axis 29. Handle or lever arm guide means 30 includes an arm guide channel 48 having parallel diametrically and transversely disposed arm support walls 31 formed inwardly from the handle face and oppositely disposed symetrical and straight bottom walls 32 and 33 which are sloped outwardly from the apex 34 at an acute angle to the handle face in "U" shaped outline to intersect the periphery 35 of the hub member which positions the pivotable arm 12 at an angle of approximately 15 degrees in either position to the handle face to provide hand clearance from the handle to the machine. The guide means 30 further includes a pair of oppositely disposed in-line bores 36 and 37 transversely and centrally located in said hub perpendicular to the transverse side walls 31 and intersecting said side walls adjacent and outwardly of said apex to fixedly receive a handle pivot pin 13.

The elongated crank arm or lever 12 has a comfort ball 22 at its free end and a bearing 38 at its pivot end 41 through which the pivot pin 13 is inserted which allows the arm to pivot about said pin from one bottom wall 32 and side of channel to the other bottom wall 33 and side of the channel, the sides and bottom walls of the channel arranged and adapted to slidably engage the side walls 39 and 40 of the arm and the arm bottom wall 42 to abutt alternatively on the bottom walls 32 and 33 of the channel to selectively lock the arm to the hub to exert radial torque on the machine spindle.

An arm securing or detent means 14 operable to releasably secure the arm in either of its two positions in the channel includes a pair of detent bores 43 having ball retaining end chamber 50 laterally disposed in the hub 11 perpendicular to the channel side walls above the bottom walls. A "V" shaped detent socket 44 is located in the arm in juxtaposition with the detent bores. The detent ball 15 is placed in the detent bore against the chamber 50 which leaves a portion of the ball extending into the channel operable to engage the detent socket 44 when the arm is rotated or pivoted from one position in the channel approximately 150 degrees to the other position. Detent spring 16 is placed behind the ball, a set screw 17 is threaded into the detend bore to place tension on the spring and force the ball into the arm socket.

In operation the handle is rotated to adjust the machine spindle, and when a point is reached where it becomes difficult because of the awkward position of the handle, which is usually towards the machine, to obtain the desired leverage on the spindle, the handle is rotated or pivoted from the existing position without turning the hub to a position in the opposite channel side where the leverage required is available.

While there is here shown and described specific embodiments of this invention, the latter is not limited to the exact details of construction set forth, and the invention embraces such changes, modifications and equivalents of the parts and their formation and arrangement as come within the purview of the appended claims.

What is claimed is:

1. A hand crank device adapted to be mounted on a spindle of a machine tool comprising;

means for mounting the hand crank in operative relationship to the machine including walls defining an axially located bore disposed at one end for fixedly mounting the hub axially to the machine spindle;

arm guide means including side walls and bottom walls defining an arm guide nesting channel transversely disposed on the opposite end of the hub perpendicular to the hub axis;

pivot bearing means including oppositely disposed in-line bearing diametrically and perpendicularly disposed on each side of said locking channel with the bearing intersecting the channel side walls and dividing the channel into two substantially equal symetrical arm nesting portions;

an elongated crank arm means including an elongated crank arm extending outwardly from the hub having a bearing portion adapted to nest slidably in the channel nesting portions including a pivot located adjacent one end of the arm axially aligned and journalled with the hub pivot bores to rotate in said channel about said pivot in a plane normal to said hub face to selectively engage one nesting portion of the channel or the other;

and detent means associated with said arm guide means and said crank arm means operable to hand releasably secure said crank arm selectively in either of said nesting channel positions.

* * * * *